US008604989B1

(12) United States Patent
Olsen

(10) Patent No.: US 8,604,989 B1
(45) Date of Patent: Dec. 10, 2013

(54) STEERABLE ANTENNA

(75) Inventor: Randall B. Olsen, Carlsbad, CA (US)

(73) Assignee: Randall B. Olsen, Carlsbad, CA (US)

( * ) Notice: Subject to any disclaimer, the term of this patent is extended or adjusted under 35 U.S.C. 154(b) by 731 days.

(21) Appl. No.: 11/603,707

(22) Filed: Nov. 22, 2006

(51) Int. Cl.
*H01Q 19/06* (2006.01)
*H01Q 1/38* (2006.01)

(52) U.S. Cl.
USPC ..... 343/754; 343/700 MS

(58) Field of Classification Search
USPC ..... 343/753, 754, 755, 700 MS; 342/374
See application file for complete search history.

(56) References Cited

U.S. PATENT DOCUMENTS

| | | | | |
|---|---|---|---|---|
| 3,761,936 | A * | 9/1973 | Archer et al. | 343/754 |
| 3,979,754 | A | 9/1976 | Archer | |
| 4,316,192 | A | 2/1982 | Acoraci | |
| 4,845,507 | A | 7/1989 | Archer | |
| 5,099,253 | A | 3/1992 | Archer | |
| 5,128,687 | A | 7/1992 | Fay | |
| 6,087,988 | A * | 7/2000 | Pozgay | 343/700 MS |
| 6,304,225 | B1 | 10/2001 | Hemmi | |
| 6,337,659 | B1 | 1/2002 | Kim | |
| 6,480,167 | B2 | 11/2002 | Matthews | |
| 6,549,171 | B1 | 4/2003 | Mailloux | |
| 6,720,931 | B1 | 4/2004 | Michisaka | |
| 6,982,676 | B2 | 1/2006 | Sievenpiper | |
| 6,992,621 | B2 | 1/2006 | Casas | |
| 7,518,566 | B2 * | 4/2009 | Schoebel | 343/772 |
| 7,728,772 | B2 * | 6/2010 | Mortazawi et al. | 342/375 |
| 7,786,928 | B2 * | 8/2010 | Hansen et al. | 342/175 |
| 2004/0027305 | A1 * | 2/2004 | Pleva et al. | 343/853 |
| 2004/0080448 | A1 * | 4/2004 | Lovberg et al. | 342/22 |
| 2005/0259005 | A1 * | 11/2005 | Chiang et al. | 342/373 |

OTHER PUBLICATIONS

Microwave Engineering, 2nd Edition, David Pozar, published by John Wiley and Sons, N.Y., p. 115.
Frontiers of Engineering: Reports on Leading Edge Engineering from the 1996 NAE Symposium on Frontiers of Engineering (1997) National Academy of Engineering (NAE).
Technology for the United States Navy and Marine Corps, 2000-2035: Becoming a 21st Century Force; vol. 2: Technology, Sensors, Module Costs.

* cited by examiner

*Primary Examiner* — Robert Karacsony

(57) ABSTRACT

An integrated phased array including an array of antenna elements (130), a plurality of waveguides (122), a beam forming network (120), and an RF switch (110). The phased array may further comprise a monolithic integration module (160) comprising a dielectric layer (165) sandwiched between two conductive layers (166, 167).

5 Claims, 15 Drawing Sheets

STEERABLE ANTENNA

CROSS-REFERENCE TO RELATED APPLICATIONS

Not applicable.

FIELD OF THE INVENTION

This invention relates to phased array antennas.

BACKGROUND OF THE INVENTION

This invention relates generally to phased array antennas and, more particularly, to phased array antenna systems that must provide multiple beams simultaneously. By adjusting the phase angles of signals received from or transmitted to multiple antenna elements in an antenna array, an antenna control system effectively steers the antenna beam, whether in a receive mode or a transmit mode.

High gain antennas are widely useful for communication purposes such as television earth station terminals for satellite communications and other sensing/transmitting uses including radar. In general, high antenna gain is associated with high directivity, which in turn arises from a large radiating aperture.

High gain antenna systems are often used in connection with television receive-only (TVRO) systems such as those in the circularly polarized direct broadcast (DBS) band and in other linearly polarized systems. TVRO systems have been available since the early 1980s to those desiring to watch television via satellite-delivered signals in their homes. A common method for achieving a large radiating aperture in TVRO applications is by the use of parabolic reflectors fed by a feed arrangement located at the focal point or focus of the parabolic reflector. Typically, large mesh or solid parabola-type antennas (i.e. backyard dishes) are placed in the yard of the consumer. Such parabolic dishes are often motorized to enable rotational movement along particular spatial arcs in which satellites are disposed thereby allowing the homeowner or consumer to view any one of a number of different satellites, one at a time. Unfortunately, movement of such parabolic antennas via the motor from one satellite to another is time consuming. For example, it may take up to two minutes or more in some instances for the motor to move a typical parabola dish-type antenna from one extreme of the arc of satellites to the other. Furthermore, mechanical systems are subject to mechanical breakdown.

Motorized parabolic antenna systems also tend to be bulky; noisy, and subject to high maintenance requirements due to their abundance of moving parts. As stated above, most such parabolic antennas can only receive one satellite signal at a time. This is because typically a parabolic antenna reflects and concentrates the received signal to its focal point. A feed is mounted at the focal point to receive the signal and direct it to an amplifier/down converter, which then directs the signal to the receiver in the home. Thus, depending upon what direction the dish is oriented; one satellite signal is focused into the focal point feed at a time.

Some prior art parabolic antennas have included multiple feeds near the center of the dish to enable the homeowner to receive multiple satellite signals simultaneously. Unfortunately, the angular range of such multi-feed systems is limited. Such multi-feed antennas typically experience a signal loss because the multi-feeds are not directly in the center (i.e. focal center) of the dish but are only in its general proximity. Additionally, parabolic antennas often include structure required to support the feed. This often adversely affects the illumination of the aperture and thereby perturbs the far-field radiation pattern.

Modern antenna systems have found increasing use of antenna arrays for high gain purposes. Phased array antennas typically consist of a plurality of stationary antenna elements that are fed coherently and use variable phase or time-delay control at each element to scan a beam to given angles in space. The primary reason for the use of such phased array antennas is to produce a directive beam that can be repositioned (scanned) electronically as opposed to by mechanical means. Variable amplitude control is sometimes also provided for pattern shaping. Single beam phased arrays are sometimes used in place of fixed aperture parabolic antennas, because the multiplicity of antenna elements allows more precise control of the radiation pattern thus resulting in lower side lobes and precise pattern shaping. Unfortunately, such systems are highly expensive and are generally for this reason not used in TVRO applications.

While phased arrays often have a single output port (per element), multiple beam antenna systems have a multiplicity of output ports, each corresponding to a beam at a different angle in space. Typical systems utilizing such multiple beam technology (and needing simultaneous, independent beams) include multiple-access satellite systems and a variety of ground-based height-finding radars. Generally, multiple beam array antenna systems utilize a switching network that selects a single beam or a group of beams as required for specific applications via a generic lens or reflector. In other cases, multiple beam arrays are used as one component of scanning systems such as the use of a multiple beam array feed for a reflector or lens system.

Array antennas generally include an array of ordinarily identical antenna elements (or plurality of elements or of sub-arrays of elements), each of which has a lower gain than the gain of the array. The antennas (or elements) are arrayed together and fed with an amplitude and phase distribution, which establishes the far-field radiation pattern. Since the phase and power applied to each element of the array can be individually controlled, the direction of the beam (transmitting and receiving) can be changed accordingly. In multiple beam systems, reflectors or lenses are used to control the beam. A salient advantage of array antennas is clearly the ability to scan the beam or beams electronically without moving the mass of a reflector as is required in prior art parabolic-type antennas.

These technologies are well tried, but they are complex and onerous in a way that rapidly increases with the size desired for the antenna. It follows from this that electronic scanning cannot be used in applications where it would be worthwhile.

For example, in conventional phased array antenna systems, each radiating element in the array has to have an independent radio frequency (RF) phase shifting circuit for each independent beam to be produced. In an illustrative satellite antenna system, an array has 547 elements and there is a requirement to produce sixteen independent beams. Thus, 8,752 phase shifting circuits are needed, together with sixteen 547-way RF power combiners to produce the sixteen independent beams. Each phase shifting circuit has to be connected to an appropriate one of the power combiners, creating a maze of crossing lines. Moreover, each of the phase shifting circuits requires its own four-bit control line to provide the requisite beam steering accuracy. The complexity of implementation increases even further as the number of independent beams rises above a modest value.

Apart from conventional phase shifters, other means have been envisaged for electronically steering multiple beams with a single aperture. This capability can be achieved by using certain beam forming networks. There are two major types of beam forming networks, namely, matrices and lenses.

One example of a matrix network is the Butler matrix described in U.S. Pat. No. 4,316,192. The Butler matrix is a linear, bilateral device with the properties of superposition and reciprocity. It has $2^N$ input ports and $2^N$ output ports. Typically, each output port is connected to a corresponding element of a linear array of radiating elements. Driving only one input port with a source of electromagnetic energy produces a single beam that has a direction corresponding to the input port that was selected. Driving multiple ports produces multiple beams. Each has a direction corresponding to the input port that was driven. If all of the input ports are driven, a cluster of $2^N$ beams results. The cluster of beams may be scanned in space if beam steering elements, such as phase shifters or time delay networks, are placed between every output port of the matrix and its corresponding radiating element. However, the beam steering elements do not permit any single beam to be steered independently of any other beam.

In the Butler matrix, signal parameters such as center frequency, total bandwidth and modulation can differ from one input port to another. Thus, different signals can be launched in different directions as long as the beams are orthogonal. Furthermore, when the Butler matrix is operated in a receive-only mode, the port from which energy emerges identifies the direction from which the energy was received.

Switching beam directions is accomplished by switching input ports. When the number of simultaneous beams is large and/or when a high power level is being used (as is common in radar, communications, and electronic warfare systems) switching input ports can become complicated.

Lens beam forming networks share the same basic properties of matrices, namely, they are linear, bilateral devices with the properties of superposition and reciprocity. Lens beam forming networks operate similarly to an optical lens, i.e. the microwave lens converts a point source of electromagnetic energy into a linear phase front.

The Ruze lens, as described by Fay in U.S. Pat. No. 5,128,687, is an example of a lens beam forming network. The Ruze lens is a line source antenna that can provide multiple, independently steerable, simultaneous beams. Like other microwave lenses, it has a focal arc with each position along that arc corresponding to a different beam direction. Pointing the beam in a particular direction is accomplished by merely placing a beam launching device at the corresponding location on the focal arc of the lens. Scanning of the beam is accomplished by moving the beam launcher along the focal arc. Using multiple beam launchers produces multiple simultaneous beams, each of which may be steered independently of the other beams. In addition, the aperture of the lens can be large enough to produce the desired far field beamwidth independent of the number of resolvable beam directions that are used.

One type of beam launcher is a waveguide. Each independent beam requires its own length of waveguide. Changing the direction of any of the multiple simultaneous beams produced by the waveguide beam launchers requires the mechanical relocation of the waveguide.

An alternative to the waveguide beam launcher is an array of monopole elements, hereinafter referred to as probes, or radiating elements mounted along the focal arc. Each probe location corresponds to a specific beam direction. When driven by an electromagnetic energy source, a probe will radiate energy in a well-defined and predetermined direction. In addition, since the lens is a reciprocal device, energy received from that direction will come to a focus at that probe.

Beam pointing angles corresponding to locations between two adjacent probes can be achieved by splitting the power from the electromagnetic source between the two adjacent probes, and by amplitude and/or phase weighting of the distributed power.

Typically, a complex network of switches directing signals to the probes on the focal arc is used to achieve rapid and random-access steering of beams. The switch network is nominally the same kind of switch network that would be required to switch between input ports of a Butler matrix or any other matrix beam forming network. As with the matrix beam forming networks, in many applications the switching network must be capable of handling high power levels.

The Ruze lens is only one of many lens antennas wherein the beam direction corresponds to a location on the focal arc. Other examples of lenses include, but are not limited to, the Rotman lens as described by Sievenpiper in U.S. Pat. No. 6,982,676 and other lenses such Archer lenses described by Archer in U.S. Pat. No. 5,099,253 and U.S. Pat. No. 4,845,507.

While beam forming networks are capable of overcoming some of the practical issues that have prevented broad application of conventional phase-shifter-based electrically steered technology, improvements are still needed. Accordingly, it will be appreciated that there is a need for a less complex technique to provide multiple independent beams from a phased array antenna system. The present invention is directed to this end.

It is apparent from the above that there exists a need in the art for a multiple beam array antenna system which is small in size, cost effective, and modular to increase gain without significantly increasing cost. There also exists a need for such a multiple beam array antenna system having the potential to receive signals simultaneously from more than a single location. It is the purpose of this invention to fulfill the above-described needs in the art, as well as other needs apparent to the skilled artisan from the following detailed description of this invention.

Those skilled in the art will appreciate the fact that array antennas are reciprocal transducers which exhibit similar properties in both transmission and reception modes. For example, the antenna patterns for both transmission and reception are identical and exhibit approximately the same gain. For convenience of explanation, descriptions are often made in terms of either transmission or reception of signals, with the other operation being understood. Thus, it is to be understood that the array antennas of the different embodiments of this invention to be described below may pertain to either a transmission or a reception mode of operation. Those of skill in the art will also appreciate the fact that the frequencies received/transmitted may be varied up or down in accordance with the intended application of the system.

SUMMARY OF THE INVENTION

Generally speaking, this invention fulfills the above-described needs in the art by providing an integrated phased array for simultaneously receiving/transmitting signals. The integrated phased array comprises the following elements: an array of antenna elements, a plurality of waveguides, a beam forming network, and an RF switch. More specifically the integrated phased array may comprise a monolithic integrated unit comprising a dielectric layer sandwiched between two conductive layers, wherein at least two of the array of antenna elements, plurality of waveguides, beam forming network, and RF switch are contained.

Another preferred embodiment of this invention provides a thickness-dimension-tolerant phased array comprising the following elements: an array of antenna elements, a plurality of waveguides, a beam forming network, an RF switch, and a thickness-dimension-tolerant monolithic module comprising a dielectric layer sandwiched between two conductive layers, wherein at least one of the array of antenna elements, plurality of waveguides, beam forming network, and RF switch, is contained within the thickness-dimension-tolerant monolithic module.

In certain further preferred embodiments of this invention, the thickness dimension tolerant monolithic module comprises one or more TEM (transverse electric and magnetic) mode waveguide structures.

This invention further fulfills the above-described needs in the art by providing a mechanically thin phased array. In yet another preferred embodiment of this invention, a compacted area phased array is provided.

Still another preferred embodiment of this invention provides a multibeam phased array comprising the following elements: an array of antenna elements, a plurality of waveguides, a beam forming network, a network switch, and a plurality of radios. Moreover, another preferred embodiment of this invention provides a 2-dimensionally (2D) steerable phased array.

In another embodiment of this invention, a high power phased array is taught which eliminates the need for high power amplifiers and hence provides a higher reliability and lower cost system.

In still another embodiment of this invention a low noise phased array is introduced which enables highly sensitive receiving systems without necessitating low loss within a beam forming network.

In yet another embodiment of this invention an auto-aligning array is taught which can eliminate truck-rolls (service calls by installation specialists) and thereby lower installation costs and time delays.

In still another embodiment of this invention, an efficient novel method of producing a low side-lobe phased array is introduced.

In another embodiment of this invention, a high gain MIMO array is taught wherein the analog processing is teamed with the digital signal processing of MIMO to produce low cost and high performance systems for line of sight and near line of sight applications.

Yet another embodiment of this invention provides a 2-dimensionally steerable phased array comprising: a 1-dimensionally electronically steerable phased array, and
a means for mechanically rotating said 1-dimensionally electronically steerable phased array. Also disclosed is a 2-dimensional beam forming network.

Another embodiment of this invention provides an electronically steerable antenna comprising: an array of antenna elements, a means to excite the antenna elements.

The antenna: is steerable by inertia-less means, is capable of scanning over at least 40 degrees, has a main beam width of less than 35 degrees, and has a mass of less than 50 kilograms (and can be made in versions with a mass of less than 1 kg).

Still another embodiment of this invention provides a steerable antenna that fits within a volume defined by 60 cm×60 cm×6 cm and another embodiment has a projected area less than 30 cm×30 cm.

Another embodiment of this invention provides a steerable antenna costs less than $1000 to fabricate. Yet another embodiment of this invention provides a steerable antenna that is isothermal to within 10 degrees Kelvin. Still another embodiment of this invention provides a steerable antenna that is substantially a conformable surface.

Another embodiment of this invention provides an electronically steerable antenna with a gain of over 10 dBi and another embodiment provides a steerable antenna with a main beam height of less than 50 degrees. Still another embodiment provides an electronically steerable antenna capable of producing at least two substantially independent main beams and another embodiment is capable of scanning over at least 60 degrees.

Yet another embodiment provides an electronically steerable antenna that consumes less than 30 Watts and another embodiment provides a steerable antenna that is self-capable of removing any heat generated from within.

This invention will now be described with respect to certain embodiments thereof, accompanied by certain illustrations, wherein:

IN THE DRAWINGS

FIG. 1*a* is a schematic view of the multiple beam array antenna system of a first embodiment of this invention.

FIG. 1*b* is an exploded side view of a monolithic integration module 160.

Figure 10B:
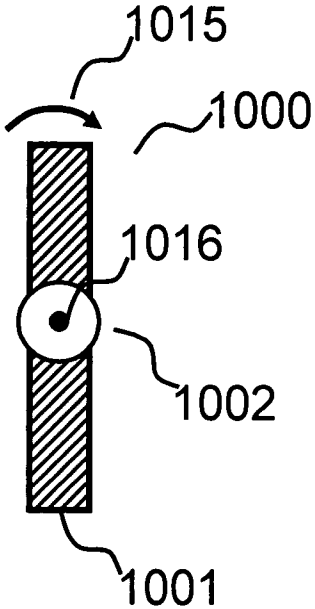
Figure 10A:
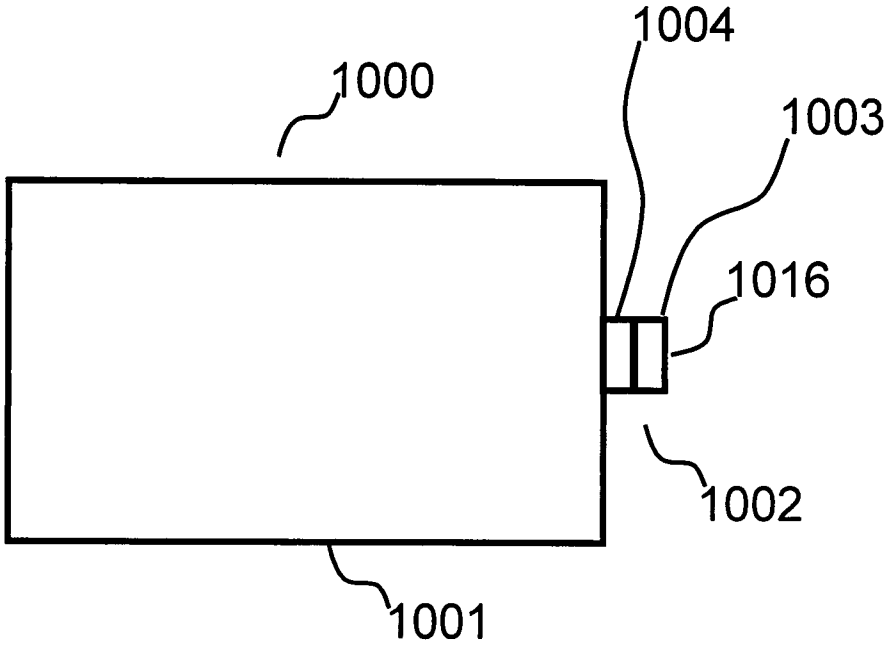

FIG. 10*a* is a front view and FIG. 10*b* is a side view of a 2D steerable phased array 1000 of a seventh embodiment of this invention.

Figure 11B:
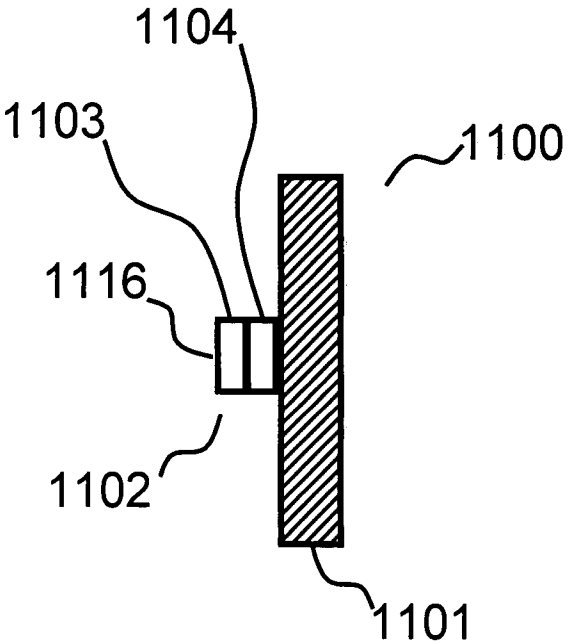
Figure 11A:
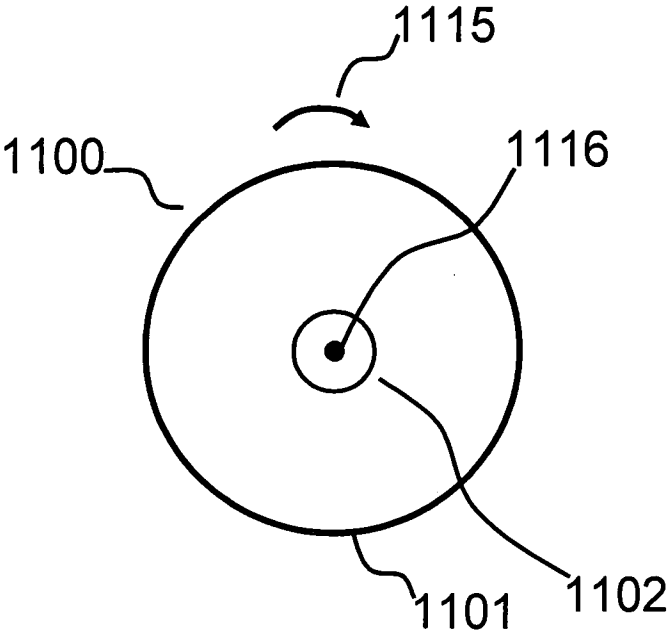

FIG. 11*a* is a front view and FIG. 11*b* is a side view of a 2D steerable phased array 1100 of an eighth embodiment of this invention.

Figure 12:
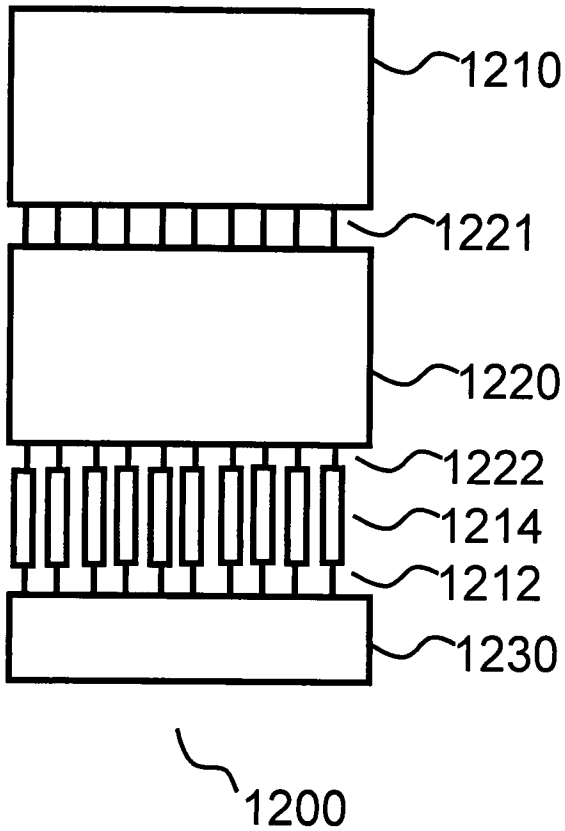

FIG. 12 is a schematic view of a high power phased array 1200 of a ninth embodiment of this invention.

Figure 13:
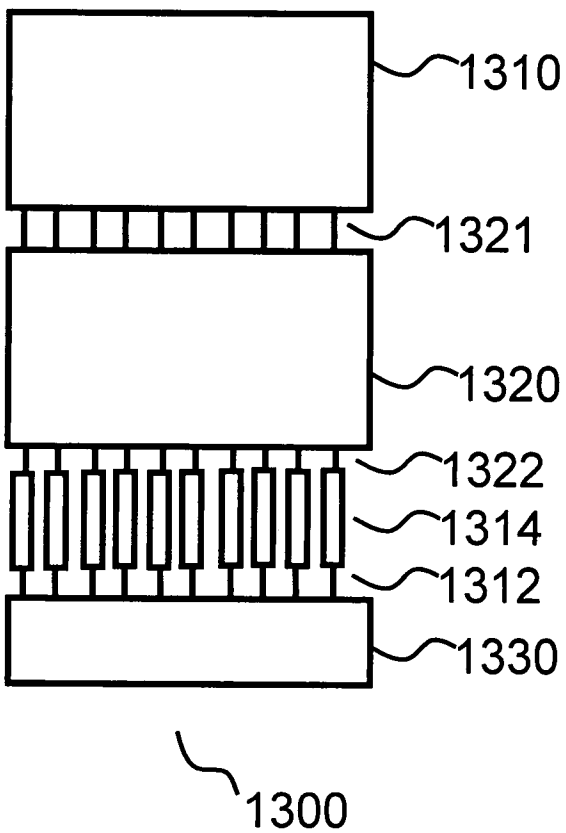

FIG. 13 is a schematic view of a low noise phased array 1300 of a ninth embodiment of this invention.

Figure 14C:
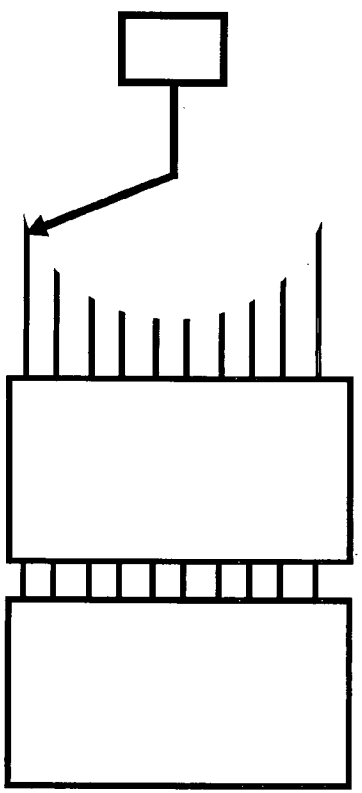
Figure 14B:
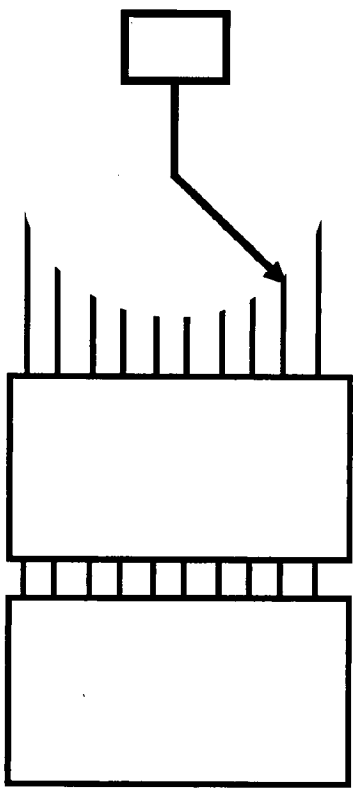
Figure 14A:
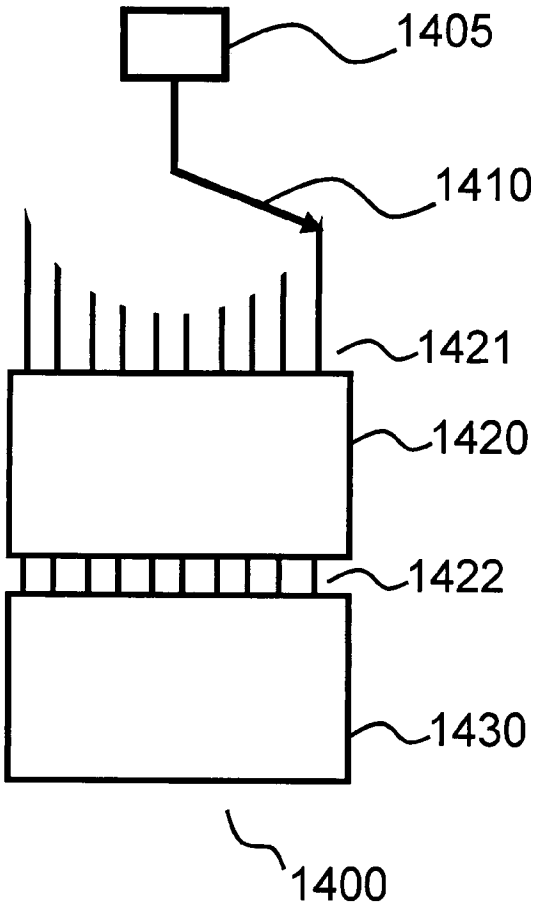

FIG. 14*a* is a schematic view of an auto-aligning phased array 1400 of a tenth embodiment of this invention.

FIG. 14*b* is a schematic view of auto-aligning phased array 1400 illustrating means for selectively connecting 1410 connecting to the second input.

FIG. 14*c* is a schematic view of auto-aligning phased array 1400 illustrating means for selectively connecting 1410 connecting to the nth input.

Figure 15:
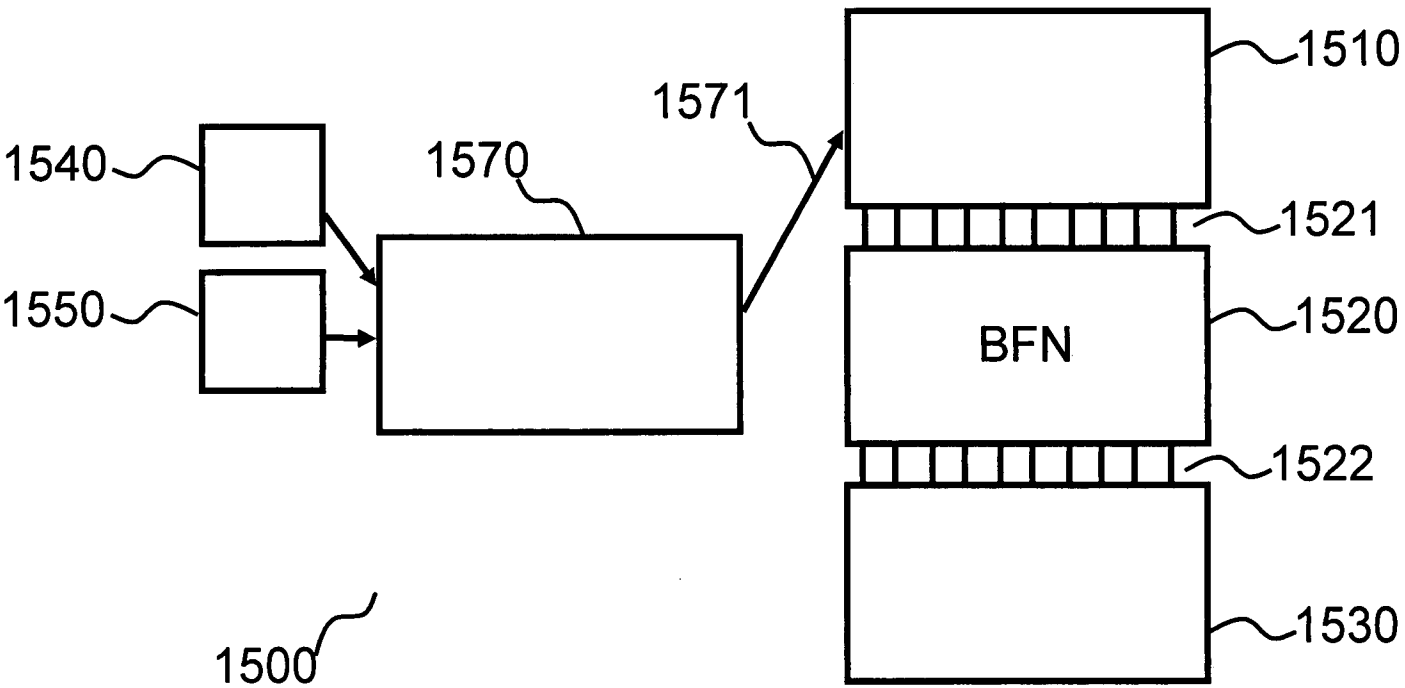

FIG. 15 is a schematic view of a self-aligning phased array of an eleventh embodiment of this invention.

Figure 16:
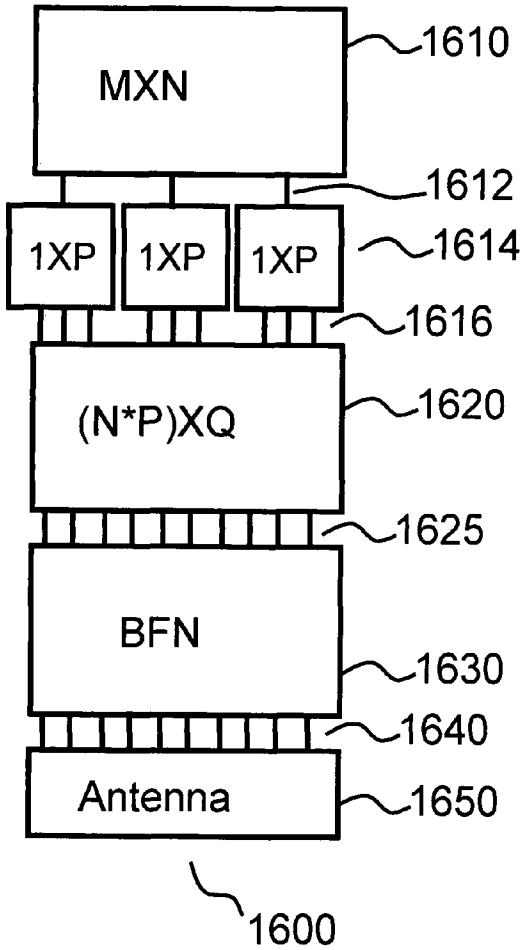

FIG. 16 is a schematic view of a low side-lobe phased array 1600 of a twelfth embodiment of this invention.

Figure 17:
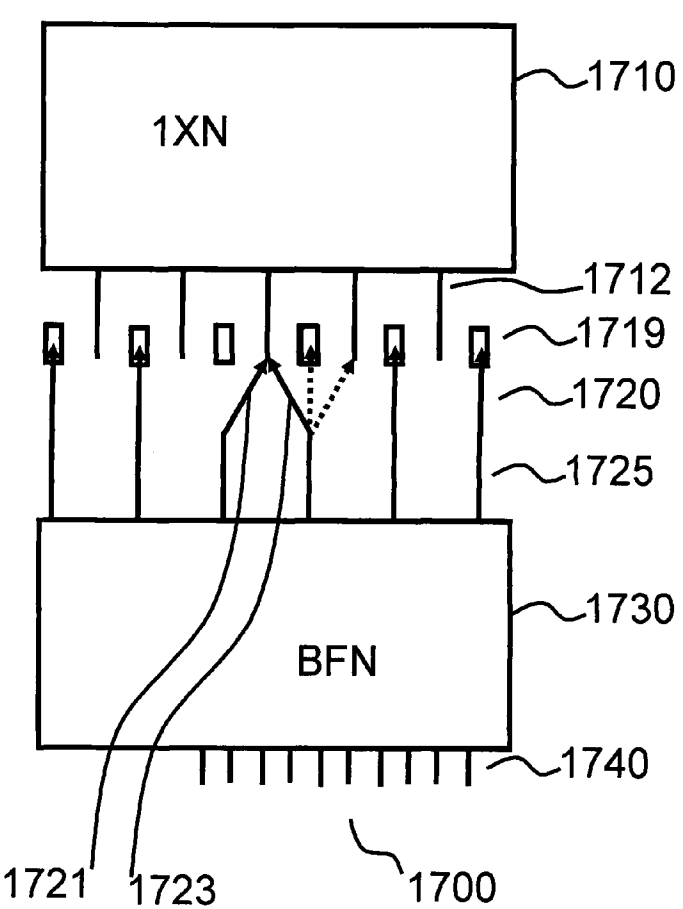

FIG. 17 is a schematic view of a portion of an example of a low side-lobe phased array.

Figure 18:
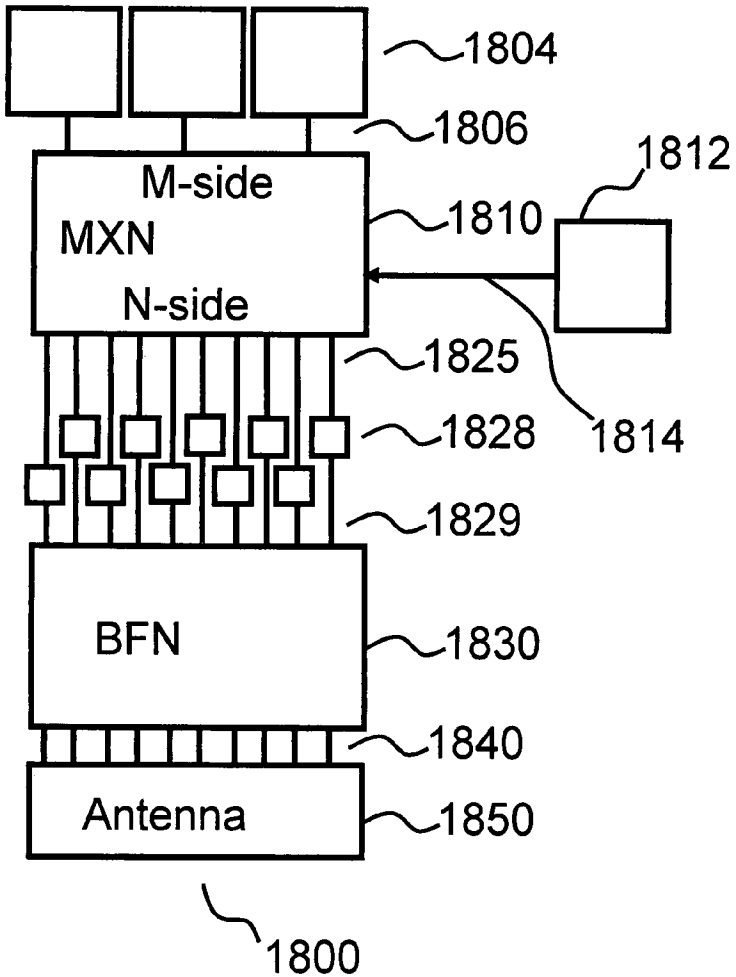

FIG. 18 is a schematic view of a MIMO enhanced phased array 1800 of a thirteenth embodiment of this invention.

Figure 19:
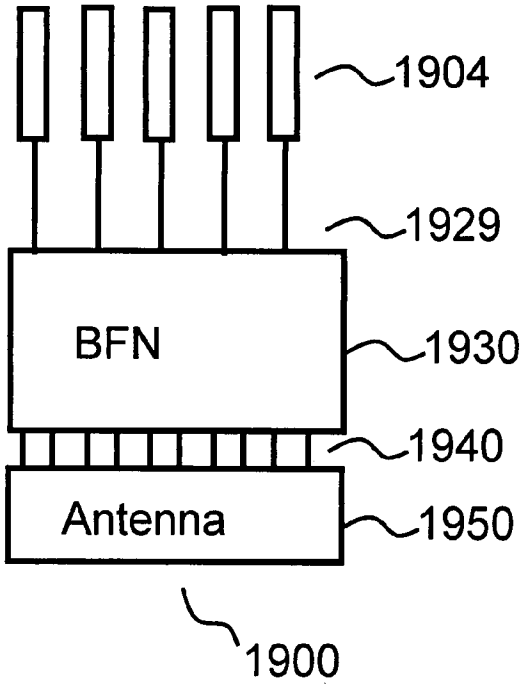

FIG. 19 is a schematic view of a high gain MIMO array 1900 of a fourteenth embodiment of this invention.

Figure 20:
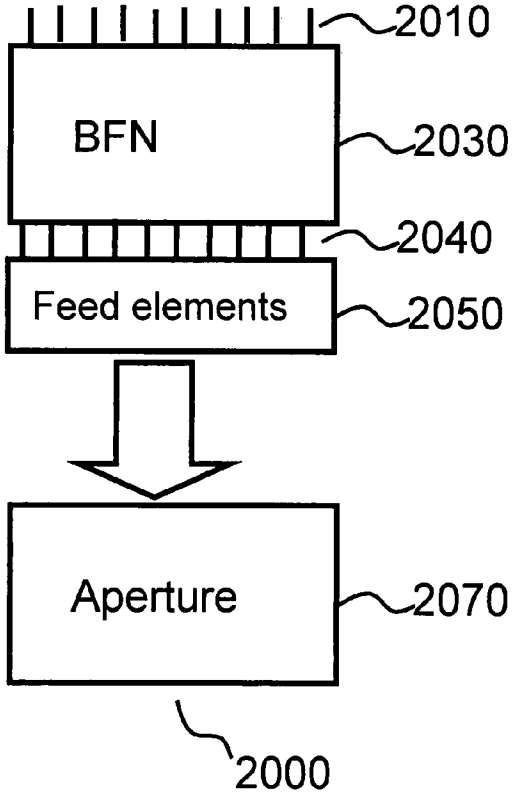

FIG. 20 is a schematic view of a multi-beam high gain array 2000 of a fifteenth embodiment of this invention.

Figure 21:
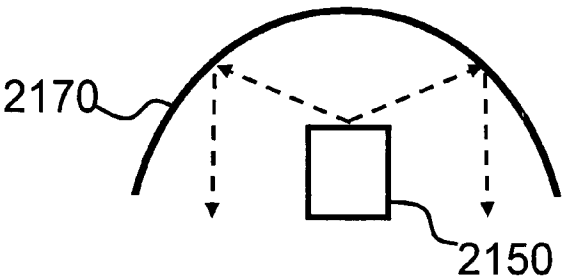

FIG. 21 is a schematic side-view of a multi-beam high gain aperture 2170 which is directly fed by array of antenna feed elements 2150.

Figure 22:
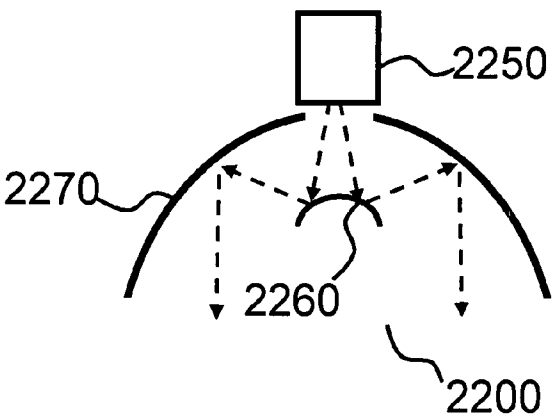

FIG. 22 is a schematic side-view of a multi-beam high gain aperture 2270 which is fed via a secondary reflector 2260 by array of antenna feed elements 2250.

Figure 23:
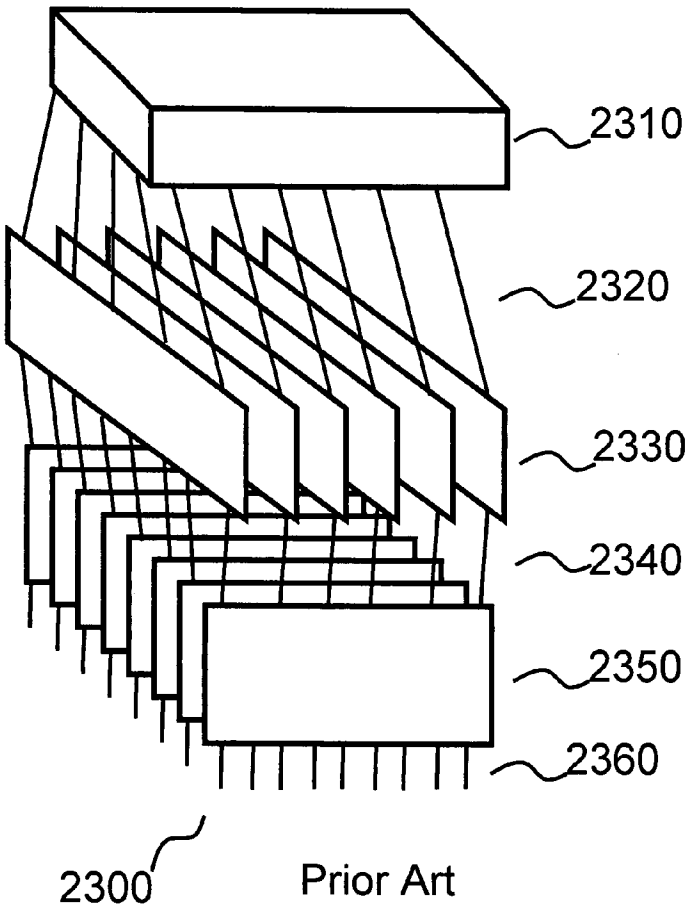
Prior Art Fig. 23

FIG. 23 is a schematic view of a 2D scanner 2300 in the Prior Art.

Figure 24:
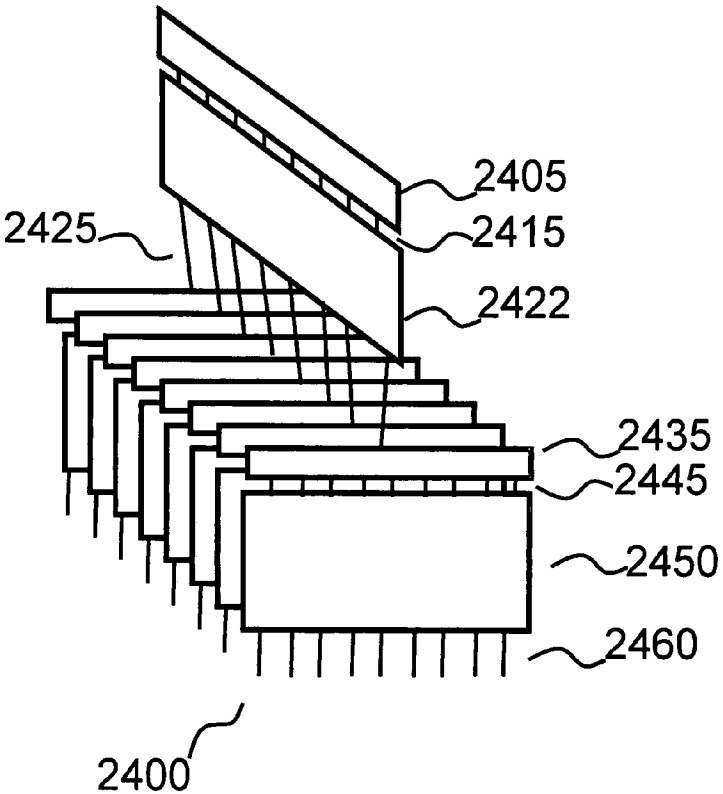

FIG. 24 is a schematic view of a 2D scanner 2400 which is another embodiment of the instant invention.

DETAILED DESCRIPTION OF CERTAIN EMBODIMENTS OF THIS INVENTION

Referring now more particularly to the accompanying drawings in which like reference numerals indicate like parts throughout the several views.

Figure 1B:
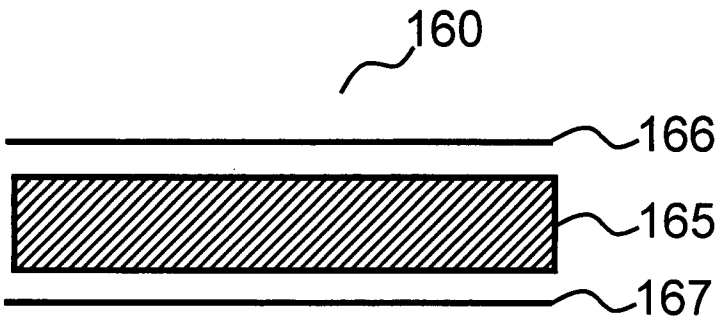
Figure 1A:
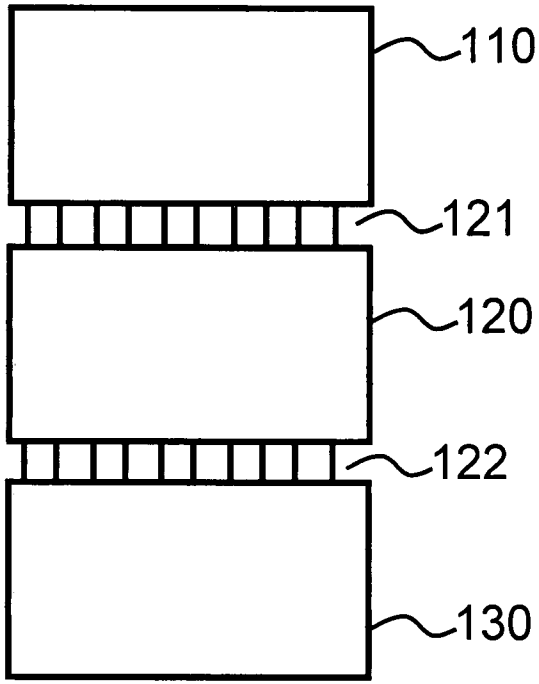

FIG. 1*a* is a schematic view of a multiple beam array antenna system of a first embodiment of this invention. A beam forming network 120 with multiple inputs 121 and multiple outputs 122 is fed at least one RF signal by a means for selectively connecting 110 to at least one of the multiple inputs 121. The beam forming network 120 operates on an input RF signal applied to one of its inputs 121 to produce multiple time delayed (or phase shifted) copies with a variety of amplitudes which are modified relative to the input RF signal. An array of antenna elements 130 is connected to the multiple outputs 122. The beam forming network 120 can, in general perform steering in two dimensions, e.g. both elevation and azimuth angles. However, costs, size and weight can be minimized when the beam forming network 120 operates in a single dimension.

FIG. 1*b* is an exploded side view of a monolithic integration module 160. The monolithic integration module 160 comprises a dielectric layer 165 sandwiched between an upper conductive layer 166 and a bottom conductive layer 167. To provide an integrated unit, with subsequent cost, simplicity, weight and volume benefits, at least two among the beam forming network 120, means for selectively connecting 110, multiple inputs 121, multiple outputs 122, and array of antenna elements 130 are contained within the monolithic integration module 160.

The term RF signal as used here means an electromagnetic signal in microwave or millimeter wave bands. Means for selectively connecting 110 can be discreet or continuous in nature. An example of discreet means is one or more switches, either electrically operated or mechanically operated. An example of an electrically operated switch is a circuit based on a PIN diode. An example of continuous means for selectively connecting 110 is a feed horn which can be slid along the surface of a lens (which is itself an example of a beam forming network).

Figure 2:
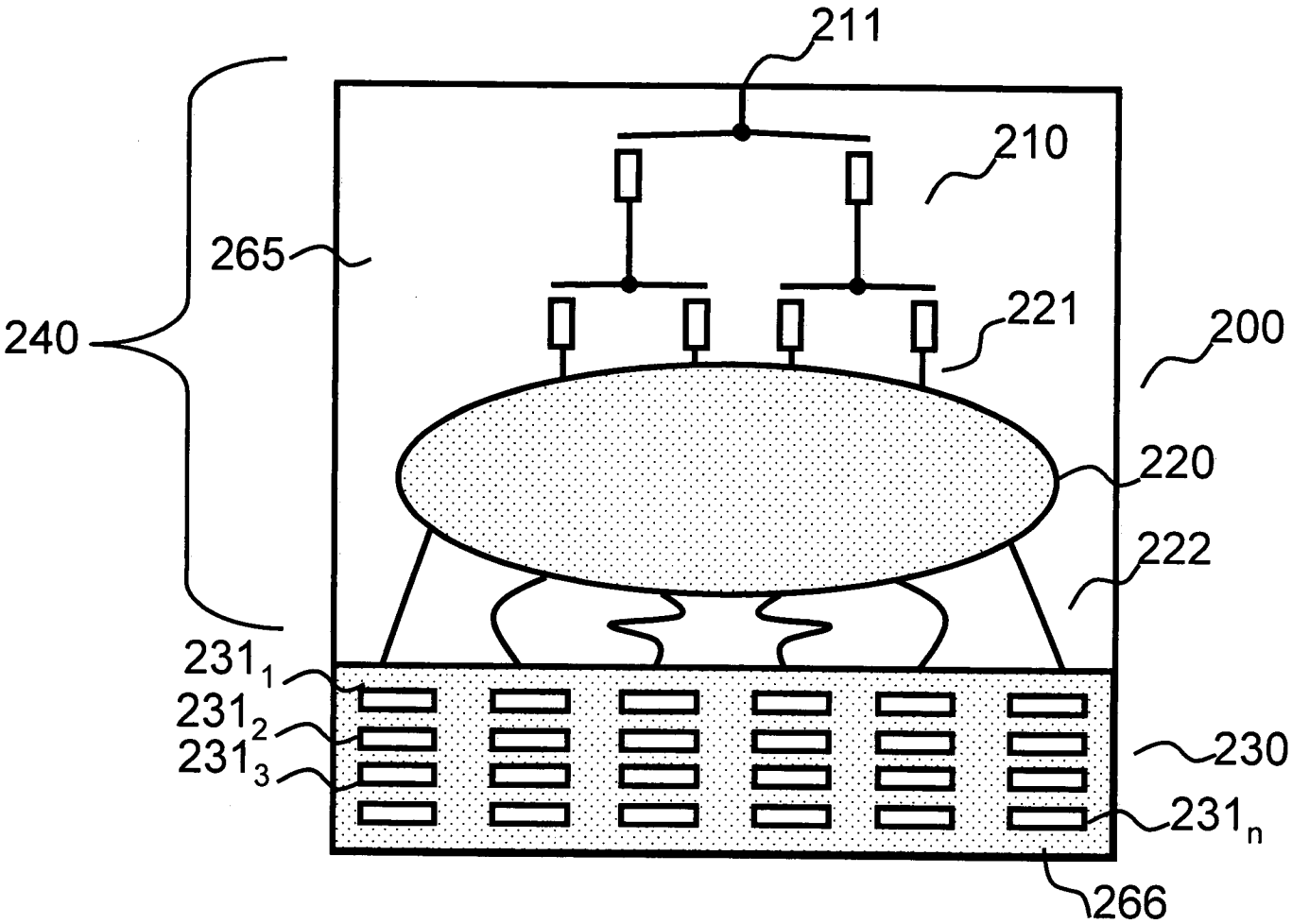
FIG. 2 is a top view of a more specific first embodiment of this invention.

FIG. 2 is a top view of a more specific first embodiment of this invention. Rotman lens 220 is an example of a beam forming network. It is fed by switch network 210, an example of a means for selectively connecting. In this illustration, switch network 210 is a corporate or binary switch tree starting from a single input 211 which can be selectively connected to any Rotman lens input 221 by appropriately setting the individual switches of switch network 210. Rotman lens 220 performs its beam forming operation on an RF signal sent from single input 211 through one of Rotman lens inputs 221 then delivers phase-shifted signals through Rotman lens outputs 222 to antenna elements 230. In this case, antenna elements 230 are provided by slots $\mathbf{231}_1$ through $\mathbf{231}_n$ etched in top conductor 266. Bottom conductor 267 (which is not visible from this orientation) is substantially a solid featureless conductive sheet. In this example, both top conductor 266 and bottom conductor 267 are copper. However, other electrical conductors can be used, including without limitation aluminum, other metals, painted, inked or vapor deposited conductors, or even polymeric conductors. In addition, in this example, glass-loaded Teflon sheet 265 is used as an example of a dielectric layer. Starting stock for this metal-surrounding-dielectric construction for use at, for example, 5.8 GHz can be obtained commercially as 0.050 inch thick Duroid 5880 from Rogers Corporation located in Rogers, Conn., USA. With the exception of the electrically activated switches, all of the features illustrated in FIG. 2 can be produced by electrochemically etching the top conductor 266 by processes common in the circuit board fabrication art. The switches of switch network 210 can be provided by PIN-diode based circuits as commonly practiced in microwave and millimeter wave art. An exciter 240, a specific example of a means to excite, comprising the elements shown in the upper portion of FIG. 2 provides signal to the antenna elements 230. Herein generally, a means to excite the antenna elements shall be defined as comprising the beamforming network plus the means of selective connection and any needed connection between the beamforming network, the means of selective connection and the antenna elements.

In this example, all three subsystems, beamforming network, antenna elements, and means of selective connection are shown to be incorporated onto a single monolithic integrated unit. The values of this integration stem from the fact that cost, complexity, weight, and size are all reduced, thus enhancing practicality. It is clear that other configurations are possible wherein only two of the three subsystems are incorporated onto a single monolithic integrated unit, yet significant cost and other benefits can still be achieved.

With certain additional considerations, the invention taught by FIGS. 1 and 2 can be realized in lightweight form. The most significant way to reduce the mass of the invention is to utilize a low density foam dielectric for dielectric layer 165. An example of such foam can be obtained from Arlon Materials for Electronics Co., Ltd. Jiangsu, China in Model FoamClad R/F 100. An additional approach for low mass is to use a TEM mode-only structure, as the thickness of such a structure will necessarily be below $\lambda_{\in}/2$ (half the wave length in the dielectric material) (see for example Microwave Engineering, $2^{nd}$ Edition, David Pozar, published by John Wiley and Sons, N.Y., pages 115-119) the resulting system will necessarily be limited in mass. This invention therefore also provides a mechanically thin phased array (wherein the array thickness is less one tenth the longest linear dimension of its aperture area). An additional strategy to reduce mass is to use only a thin layer of conductor. Specifically, one can use less than 10 skin depths of a conductor without increasing the electrical losses within the structure. Moreover, one can reduce the thickness down to below 3 skin depths with only small increases in electrical losses and thus achieve low conductor mass. When such thin layers employed it may be advisable to provide a protective overcoat to prevent oxidation of the conductor lest the long term performance suffer degradation. Of course, it is understood that the above listed approaches to achieving low mass can be used in combinations as well as alone.

It should also be apparent that the invention readily lends itself to being applied to conform to preexisting surfaces either flat or non-flat, including vehicles, fixed structures (e.g. buildings, towers, and billboards), and even garments worn by humans and other animals.

When one employs a TEM-mode (transverse electric and magnetic mode) structure in the instant invention, a very important benefit is the production of a dimensionally tolerant product. This dimensional tolerance enables a low production cost quite distinct from expensive conventional microwave waveguide hardware.

Figure 3:
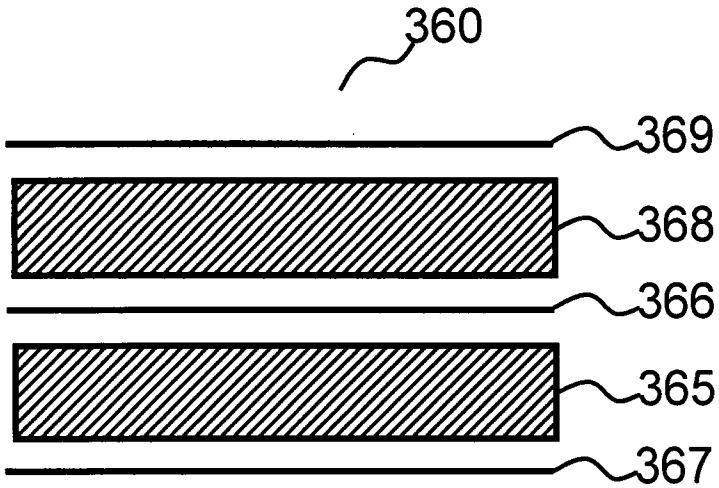
FIG. 3 is an exploded side view of a second embodiment of this invention.

FIG. 3 is an exploded side view of a second embodiment of this invention. What is shown in FIG. 3 is similar to FIG. 1*b* except that two more layers have been added to the construction. Those practiced in the microwave art will recognize FIG. 1*b* to correspond to microstrip waveguides while FIG. 3 enables stripline waveguides. Though microstrip has its advantages, e.g. two less layers and greater accessibility for adding circuit components, stripline has yet other advantages. The three main advantages of stripline construction are 1) support for true TEM propagation, 2) reduced crosstalk between nearby waveguides and 3) reduced radiation loss. The value of true TEM propagation is that fabrication tolerances are much less stringent, hence enabling lower fabrication costs. Whereas, the propagation constant for TE (transverse electric) or TM (transverse magnetic) mode propagation depends on the relationship between the wavelength (frequency) of the RF signal and the dimensions of a waveguide, the TEM mode does not depend on such a relationship and is a constant independent of frequency and waveguide dimension. Thus, waveguide dimensional variations which would be entirely unacceptable for TE or TM devices (e.g. 10% thickness variation) can be tolerated in TEM-based devices.

For example, since the waveguide wavelength for TE and TM modes is proportional to the waveguide thickness, a 10% change in thickness causes a 10% change in waveguide wavelength (for TE and TM modes only). Thus a device that is nominally five (5) wavelengths long can have a one-half-wavelength error (i.e. be totally out-of-phase with itself) if the thickness is allowed to vary by 10% (for TE and TM modes only). By contrast, a TEM mode-based device would suffer no such de-tuning caused by thickness variations. For larger devices, say 50 wavelengths long, the de-tuning could occur with just 1% thickness variations (for TE and TM modes only). Whereas a TE or TM mode device will suffer serious de-tuning before thickness errors approach the quantity 50%/(number of wavelengths electrical size of the device), the instant invention can retain its tuning. Thus, an antenna's sensitivity to this dimension change varies depending on the electrical size such that larger electrical antennas are more sensitive.

An additional advantage of stripline construction is that the electromagnetic waves are protectively encased in a conductive container and hence much less susceptible to vibration or other geometric distortions (e.g. thermally induced strains) which could otherwise disturb the electromagnetic waves and hence reduce the performance of an antenna system.

Yet a further advantage of stripline construction is that highly non-planar geometries can be executed, as later illustrated in FIG. 6, without concern of either shorting out signal or affecting evanescent electromagnetic waves in the air about the top conductor, which would otherwise be of concern with a microstrip construction.

To provide the advantages just described, at least one amongst the beam forming network 120, means for selectively connecting 110, and array of antenna elements 130 are contained within a dimensionally tolerant module 360 comprising the following elements: a bottom conductive layer 367, a middle conductive layer 366, a top conductive layer 369, a lower dielectric layer 365, and an upper dielectric layer 368. The lower dielectric layer 365 is sandwiched between the bottom conductive layer 367 and the middle conductive layer 366, and the upper dielectric layer 368 is sandwiched between the middle conductive layer 366 and the top conductive layer 369.

Figure 4:
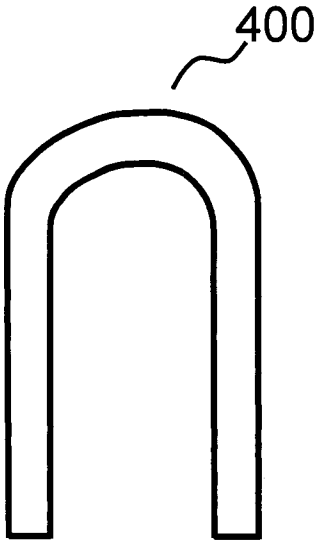
FIG. 4 is side view of a third embodiment of this invention.

FIG. 4 is side view of a third embodiment of this invention, and is an example of a compacted area module. A compacted area module is herein defined a module of reduced projected area (sometimes called footprint). An example would be a compacted module with a maximal projected area of less than 90% of the surface area of its layers. Folded module 400 is a multilayer structure similar to those shown in FIG. 1*b* and FIG. 3, but instead of being essentially planar, folded module 400 has been formed around a single bend line. Folded module 400 is an example of a folded module. The advantage of fabricating this, and other related compacted area modules, is to reduce the overall area of a steerable phased array and hence increase its practical utility.

Ordinary circuit board fabrication techniques are incapable of creating a form as illustrated in FIG. 4 since typical microwave circuit boards are too stiff. This is due, in large part, to the fact that the starting material is typically a tri-layer with two copper layers sandwiching a dielectric layer. While sufficient thinning of all three layers can produce the requisite flexibility to allow a substantial (180°) bend as shown in FIG. 4, such thinning will generally result in excessive electrical losses in the resulting waveguides.

However, if one uses an improved method, which will be described next, then a folded shape as shown in FIG. 4 can be produced without creating an electrically lossy waveguide structure. The key is to follow a novel procedure.

Figure 5:
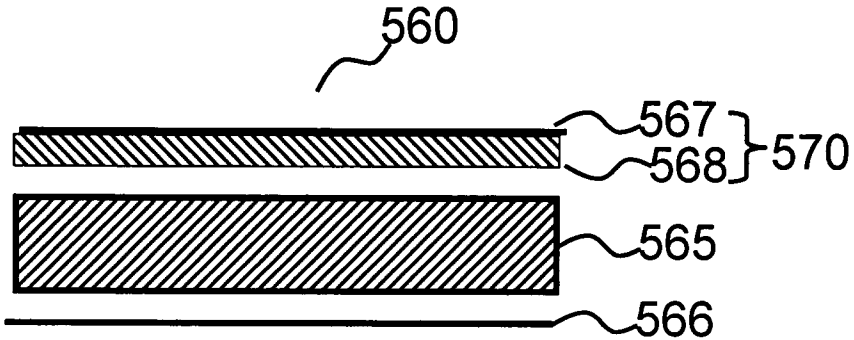
FIG. 5 is a partially-exploded side view illustrating how a compacted area module can be fabricated.

FIG. 5 is a partially-exploded side view illustrating how a compacted area module can be fabricated. The compacted area module 560 comprises the following elements: a dielectric layer 565 sandwiched between a bottom conductive layer 566 and a bi-layer 570. The bi-layer 570 in turn comprises a dielectric support layer 568 atop which is attached a top conductive layer 567.

The bi-layer 570 by itself is very flexible due to comprising both sufficiently thin dielectric support layer 568 and top conductive layer 567. For example, top conductive layer 567 can be ½ ounce (0.0007 inch thick) or even 1 ounce (0.0014 inch thick) copper obtainable, for example, from Gould Electronics, Chandler, Ariz., USA, and dielectric support layer 568 can be 0.001 inch thick polyester obtainable, for example, from Grafix Plastics, Cleveland, Ohio, USA. Dielectric support layer 568 enables features, like those illustrated in FIG. 2, to be etched into top conductive layer 567 without concerns that the features might break or move during subsequent handling.

The bottom conductive layer 566 by itself is very flexible due to it comprising a sufficiently thin conductive layer. For example, bottom conductive layer 566 can be ½ ounce (0.0007 inch thick) or even 1 ounce (0.0014 inch thick) copper.

Whereas dielectric layer 565 of sufficient thickness to avoid serious microwave losses would be fairly stiff when bonded to two or even just one metallic layer such as the ½ ounce or 1 ounce copper, the same dielectric layer 565 can be quite flexible by itself. For a specific example of a material which can be used for the dielectric, the Arlon material mentioned earlier (Model FoamClad R/F 100, Arlon Materials for Electronics Co., Ltd. Jiangsu, China) can be used if its conductive cladding has been etched away.

Hence, the three layers of FIG. 5 are all flexible when considered by themselves, i.e. before they are bonded together. Thus, the three layers can be individually and sequentially folded, for example by bending around a mandrel or other form. To form a substantially permanent bond between the layers, module 560 can be heat-treated, for example by placement in an oven, to achieve a temperature high enough to soften dielectric layer 565. An alternative method to bond the layers together is to apply adhesive to the surfaces of mutual contact between the layers.

Figure 6:
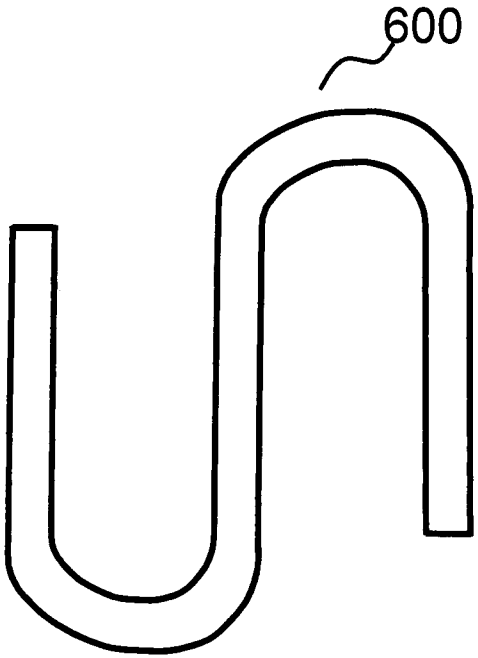
FIG. 6 is side view of a forth embodiment of this invention, and a second example of a compacted area module.

FIG. 6 is side view of a fourth embodiment of this invention, and a second example of a compacted area module. Multiply-folded module 600 is a multilayer structure similar to those shown in FIG. 1*b* and FIG. 3, but instead of being essentially planar, multiply-folded module 600 has been formed around multiple bend lines. The methods for fabricating multiply-folded module 600 are similar to those just described for folded module 400, the difference being that the folding process requires multiple folds rather than a single fold.

Figure 7:
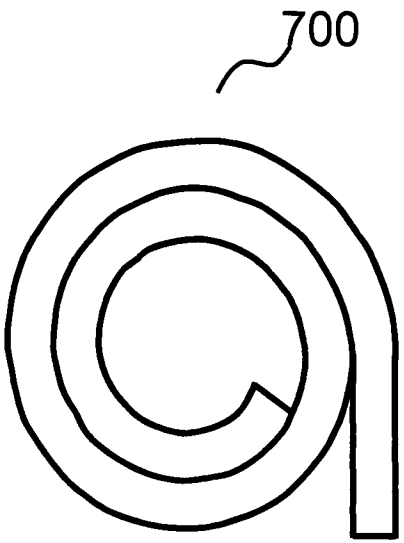
FIG. 7 is side view of a fifth embodiment of this invention, and a third example of compacted area module.

FIG. 7 is side view of a fifth embodiment of this invention, and a third example of a compacted area module. Rolled module 700 is a multilayer structure similar to those shown in FIG. 1*b* and FIG. 3, but instead of being essentially planar, rolled module 700 has a shape similar to that of a jelly roll, i.e. that of a sheet or layer, which has been rolled up into a spiral. Rolled module 700 can be formed, for example, by wrapping the flexible layers around a cylindrical mandrel or other similar fixture.

Figure 8:
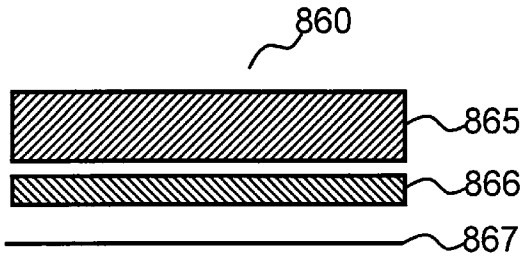
FIG. 8 shows a side view of a temporary tri-layer 860 which can be used in an alternative method of fabricating a compacted area module, which does not require bi-layer 570.

FIG. 8 shows a side view of a temporary tri-layer 860 which can be used in an alternative method of fabricating a compacted area module, which does not require bi-layer 570. The function of temporary buttress layer 865 is to provide mechanical strength and support for top conductive layer 867, but only during the fabrication process. In other words, whereas dielectric support layer 568 remains an integral part of the final construction, temporary buttress layer 865 does not. Temporary buttress layer 865 is temporarily held to top conductive layer 867 by temporary adhesive layer 866. After top conductive layer 867 has been formed or rolled in a compacted area module, temporary buttress layer 865 is removed by, for example, peeling temporary buttress layer 865 away from the surface of top conductive layer 867.

In addition to the compacted area approaches taught in FIGS. 4 through 8, another method can be used which involves incorporating high relative dielectric constant materials in place of lower relative dielectric constants materials. This tactic can be used alone or in combination with the approaches just listed. By using a high relative dielectric constant material, one can shrink the size of the beam forming network and other subsystems by a linear scale factor proportional to the square root of the relative dielectric constant. Thus, for example, a beam forming network with J ports will shrink from a size of approximately J times the wavelength (in vacuum)/2 to a size of just J times wavelength (in dielectric)/2. Since the linear size scale factor is factor proportional to the square root of the relative dielectric constant, the area size scale factor is directly proportional to the relative dielectric constant. Thus, for a relative dielectric constant of 2, the resultant beam former can function with only one half the area of a beam former based on a low relative dielectric constant (approaching 1) material. Similarly for a relative dielectric constant of 10, the resultant beam former can function with only one tenth the area of a beam former based on a low relative dielectric constant (approaching 1) material, and similarly so for even higher dielectric constant materials.

Figure 9:
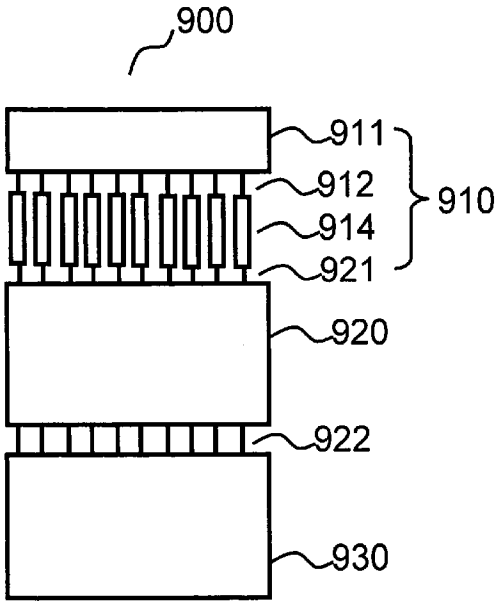
FIG. 9 is a schematic view of a network-switched multiple beam array antenna system 900 of a sixth embodiment of this invention.

FIG. 9 is a schematic view of a network-switched multiple beam array antenna system 900 of a sixth embodiment of this invention. System 900 comprises a data network switch/router 911 with data network ports 912. A plurality of radios 914 are attached to the data network ports 912. A beam forming network 920 comprising input ports 921 and output ports 922, has its input ports 921 connected to the radios 914. System 900 further comprises an array of antenna elements 930 which are connected to the output ports 922. The term data network switch/router is used here to avoid confusion with the beam forming network. The term includes both data network switch and data network router (and devices which have properties of both). It should be realized that the data network switch/router can handle a wide variety of "data" including voice and video and other application information streams. An example of a data network switch/router is a model Cisco 3825 Integrated Services Router available from Cisco Systems, Inc. San Jose, Calif., USA.

In transmission operation, data received by data network switch/router 911 is selectively sent to the radios 914, which convert the data into RF signals. The RF signals are then sent to the beam forming network 920 then after phase and amplitude processing sent to the antenna elements 930 where the antenna elements 930 then transmit the processed RF signals. In reception operation, the reverse process takes place. Data network switch/router 911 can be described as a 1×N if only a single beam (at a given instant in time) is needed or as M×N if a plurality, M, of beams are needed simultaneously.

This novel architecture takes advantage of the fact that data network switches are generally less expensive than RF switches. Furthermore, since radio costs are in some instances very inexpensive (on the order of 1 dollar U.S.), for example chip radios that conform to IEEE Standard 802.11, the cost of a system with many radios can be very insensitive to the number of radios utilized. In other words, prior art has focused on minimizing the number of radios, since they have generally been assumed to be expensive, while the present invention capitalizes on the inexpensive nature of some radios and therefore creates an affordable system by eliminating the need for an expensive RF switch.

FIG. 10*a* is a front view and FIG. 10*b* is a side view of a 2-dimensional (2D) steerable phased array 1000 of a seventh embodiment of this invention. The 2D steerable phased array 1000 comprises a 1-dimensional (1D) electronically steerable phased array 1001, and a means for mechanically rotating 1002 the 1D electronically steerable phased array 1001.

Also shown in FIGS. 10*a* and 10*b* is a rotational pivot point 1016 and a rotation arrow 1015 showing how 1D electronically steerable phased array 1001 can be rotated in an elevation direction to provide 2D steering.

The means for mechanically rotating 1002 can further comprise a mount 1003 and a motor 1004 attached to mount 1003. The 1D electronically steerable phased array 1001 is rotatably attached to mount 1003 and motor 1004. Motor 1004, when activated, causes rotary motion of the 1D electronically steerable phased array 1001 relative to mount 1003.

The 1D electronically steerable phased array 1001 can comprise, for example, an array of antenna elements comprising a dielectric layer sandwiched between two conductive layers, as illustrated in FIG. 1B, FIG. 3, or FIG. 5.

This geometry is particularly valuable for phased arrays which are long and narrow, for example for 1D electronically steerable phased array 1001 which is at least twice as long in one surface direction as it is in the remaining perpendicular surface direction (i.e. not the thickness dimension). For geometries more closely approximating a square, a different rotational geometry can have better utility as shown in the next figure.

FIG. 11*a* is a front view and FIG. 11*b* is a side view of a 2D steerable phased array 1100 of an eighth embodiment of this invention. The 2D steerable phased array 1100 comprises a 1D electronically steerable phased array 1101, and a means for mechanically rotating 1102 the 1D electronically steerable phased array 1101.

Also shown in FIGS. 11*a* and 11*b* is a rotational pivot point 1116 and a rotation arrow 1115 showing how 1D electronically steerable phased array 1101 can be rotated in a roll direction to provide 2D steering. This geometry is particularly valuable for phased arrays which are substantially equal length in both of their surface dimensions, for example, for a 1D electronically steerable phased array 1101 which is less than twice as long in one surface direction as it is in the remaining perpendicular surface direction.

The means for mechanically rotating 1102 can further comprise a mount 1103 and a motor 1104 attached to mount 1103. The 1D electronically steerable phased array 1101 is rotatably attached to mount 1103 and motor 1104. Motor 1104, when activated, causes rotary motion of the 1D electronically steerable phased array 1101 relative to mount 1103.

The 1D electronically steerable phased array 1101 can comprise, for example, an array of antenna elements comprising a dielectric layer sandwiched between two conductive layers, as illustrated in FIG. 1B, FIG. 3, or FIG. 5.

FIG. 12 is a schematic view of a high power phased array 1200 of a ninth embodiment of this invention. High power phased array 1200 comprises the following elements: a beam forming network 1220 with multiple inputs 1221 and multiple outputs 1222, a means for selectively connecting 1210 to at least one of multiple inputs 1221, an array of antenna elements 1230, and a plurality of medium power amplifiers 1214. Medium power amplifiers 1214 can be connected to at least one of antenna elements 1230, as shown in FIG. 12, or medium power amplifiers 1214 can be connected to beam forming network 1220 (such connection is not illustrated).

The value of this configuration is that high powered microwave or millimeter wave signals can be transmitted by this system without employing any high power amplifiers. Herein, high power amplifiers are taken to be those capable of power outputs exceeding 20 dBm, and medium power amplifiers are taken to be those capable of power outputs exceeding 10 dBm but not 20 dBm.

The reason that this innovation is so important is explained by considering the situation in the prior art. In the prior art for cell phone base stations, a radio frequency cable usually runs several tens of meters from a large antenna tower to the inside of the base station. The long radio frequency cable unnecessarily consumes more than a half (3 dB) of the transmission power. To keep field intensity necessary to the mobile station in a cell, an amplifier in a forward path should output a higher power than that necessary to compensate loss within the cables. However, as output of the power amplifier becomes higher, the amplifier becomes more expensive and larger. In addition, the efficiency of the amplifier becomes worse. As the efficiency of the amplifier is low, unnecessary power dissipated as heat is increased. The increase heat load drives up the need for a cooling fan or air conditioner in order to remove the heat. This in turn causes additional prime power consumption.

The life span of the high power amplifier with low efficiency is short and represents a major reliability limiter. In addition, if the amplifier fails, communication service is severely deteriorated and even absolutely interrupted. To avoid this, one usually needs a spare high power amplifier added to the system. Thus, the instant invention can avoid these system problems associated with high power amplifiers in cell phone base stations and other conventionally high power wireless systems by placing medium power amplifiers between the beam forming network and the antenna elements.

It will generally be desirable to retain the narrow beam capability of a phased array, hence, means for selectively connecting 1210 can comprise an RF switch. Alternatively, there may be applications where is it desirable to create and use a broad beam (e.g. for broadcasting or for reduced system complexity). In this case, means for selectively connecting 1210 can optionally comprise a signal splitter.

For some systems it may be desirable to be able to toggle (i.e. switch) between narrow beam operation and broad beam operation. In this case, means for selectively connecting 1210 additionally comprises an RF switch, a signal splitter, and a means for toggling between the RF switch and the signal splitter.

It is important to note that the beam forming network is necessary to achieve an effectively broad beam (actually a composite of many narrow beams) in a system for which high power amplifiers are to be eliminated. At first it may appear that, all that would be required would be a signal splitter followed by low (or medium) power amplifiers and then antenna elements. The apparent, trivial, counter-example to the novelty of the instant invention unfortunately would not work as intended. Though it would eliminate the high power amplifier, it would not produce a broad beam. Instead, it would produce a narrow beam pointed in one fixed direction. This is in stark contrast to the instant invention which can produce a narrow beam electronically steerable over a wide angle or alternately (by means of the toggle switch) an effectively broad beam.

FIG. 13 is a schematic view of a low noise phased array 1300 of a tenth embodiment of this invention. Low noise phased array 1300 comprises the following elements: a beam forming network 1320 with multiple inputs 1321 and multiple outputs 1322, a means for selectively connecting 1310 to at least one of multiple inputs 1321, an array of antenna elements 1330, and a plurality of low noise amplifiers 1314. Low noise amplifiers 1314 can be connected to at least one of antenna elements 1330, as shown in FIG. 13, or alternatively, low noise amplifiers 1314 can be connected to beam forming network 1320 at the multiple inputs 1321 (such second alternative is not illustrated).

The value of the first alternative configuration is that weak microwave or millimeter wave signals can be received by this system without suffering the noise losses that would otherwise occur if low noise amplifiers were to be placed later, e.g. after the beam forming network, in the receive chain. This enables the utilization of beam forming networks that, while cost effective, might otherwise be undesirable due to excessive noise figure contributions to the system.

The value of the second alternative configuration is that the beam forming network operates as a spatial filter which is highly linear (when no active elements, e.g. amplifiers, are included in the antenna plus beam forming network subsystem). This high linearity enables high dynamic range functionality for the receiving system. What this means is that large unwanted signals can be discriminated against in the instant invention since they will in most cases originate at spatial angles which will be greatly suppressed by the spatial filtering of the beam forming network.

It will generally be desirable to retain the narrow beam capability of a phased array, hence, means for selectively connecting 1310 can comprise an RF switch. Alternatively, there may be applications where is it desirable to create and use a broad beam. In this case, means for selectively connecting 1310 can optionally comprise a signal splitter.

For some systems, it may be desirable to be able to toggle between narrow beam operation and broad beam operation. In this case, means for selectively connecting 1310 additionally comprises an RF switch, a signal splitter, and a means for toggling between the RF switch and the signal splitter.

FIG. 14*a* is a schematic view of an auto-aligning phased array 1400 of an eleventh embodiment of this invention. Auto-aligning phased array 1400 comprises the following elements: a beam forming network 1420 with a plurality of inputs 1421 and a plurality of outputs 1422, a means for selectively connecting 1410 to at least one of the plurality of inputs, an array of antenna elements 1430, and a means for sensing RF power 1405.

Auto-aligning phased array 1400 operates by sequentially pointing in all of its different beam directions and measuring RF power corresponding to each of those directions. Then, by determining which direction provides the strongest signal, auto-aligning phased array 1400 points itself in such direction.

In detail, the method involves having the means for selectively connecting 1410 execute a first procedure comprising the following steps: connecting to a first input, waiting for a first dwell time, connecting to a second input, waiting for a second dwell time, and so forth until, connecting to an nth input, and waiting for an nth dwell time. FIG. 14*b* is a schematic view of auto-aligning phased array 1400 illustrating means for selectively connecting 1410 connecting to the second input. FIG. 14*c* is a schematic view of auto-aligning phased array 1400 illustrating means for selectively connecting 1410 connecting to the nth input. During this first procedure, means for sensing RF power 1405 additionally executes a second procedure which is coordinated with the first procedure.

The second procedure comprises the following steps: attempting to detect a first signal corresponding to a first direction during the first dwell time, attempting to detect a second signal corresponding to a second direction during the second dwell time, and so forth until, attempting to detect an nth signal corresponding to an nth direction during the nth dwell time.

During this second procedure, the means for sensing RF power 1405 records the first signal strength, the second signal strength, and so on through the nth signal strength. Thereafter the means for sensing RF power 1405 compares the first through nth signal strengths and determines which is strongest.

Then means for selectively connecting 1410 subsequently connects the means for sensing RF power 1405 to the input corresponding to the strongest signal, thereby pointing the auto-aligning phased array.

The means for sensing RF power 1405 may further comprise a receiver, and a means for detecting and decoding signals from the receiver. The means for detecting and decoding may be capable of establishing a communication link with a distant node. Furthermore, the first through nth records of signal strength may further comprise bit error measurements of data received from the distant node. It is important to note, that with a receiver, or receiver-like means for detecting, it is possible to not only detect RF power, but also to establish that the source of RF power is a desirable transmitter, i.e. not an interferer nor a jammer or the like, and suitability of that transmitter. Thus with a receiver, as opposed to a simple power detector, an auto-alignment procedure can ensure alignment with a desirable transmitter as opposed to an undesirable interferer or jammer. Furthermore, the relative suitability of a number of desirable transmitters can be determined based on, for example, the measured signal strength. Alternatively, a higher suitability might be assigned to a weaker, say more distant transmitter, since from a network system perspective, communication with such a distant transmitter might reduce the number of wireless hops between nodes and thus improve either latency or jitter or overall throughput or any or all of the above. These are only a sampling of what a wireless network designer might choose for determining relative suitability ranking. It is clear that with the use of a receiver that can actually talk with distant nodes, a wide variety of optimization approaches can be used for pointing each of many steerable antennas.

FIG. 15 is a schematic view of a self-aligning phased array 1500 of a twelfth embodiment of this invention. The self-aligning phased array 1500 comprises the following elements: a beam forming network 1520 with a plurality of inputs 1521 and a plurality of outputs 1522, a means for selectively connecting 1510 to at least one of the plurality of inputs 1521, an array of antenna elements 1530, a means for determining self-location/orientation information 1540, means for determining neighbor location information 1550, and a means for computing 1570 which inputs to the means for selectively connecting 1510 a control signal 1571 which corresponds to beams pointing in the direction of the other wireless nodes. A specific example of a means for determining self-location/orientation information is an inertial navigation unit (INU). An INU ideally can provide both location information (e.g. latitude, longitude and elevation) and orientation information (rotation angles relative to a global coordinative system). An INU can be, for example, model INU-75 GB obtained from Mercury Computer Systems, Inc. located in Chelmsford, Mass., USA. Another option for self orientation information is a compass.

A specific example of a means for determining self-location information is a global positioning satellite (GPS) receiver or other receiver of location information. The GPS receiver can be, for example, Garmin Model-GA004802 obtained from The GPS Store, Inc., located in Ocean Isle Beach, N.C., USA.

The means for determining neighbor (i.e. nearby wireless nodes) location information 1550 can be preinstalled, for example when self-aligning phased array 1500 is manufactured or at any later time, either by human or machine methods. The means for determining neighbor (i.e. nearby wireless nodes) location information 1550 can further comprise out-of-band means of communication (not illustrated), wherein knowledge of locations of nearby wireless nodes is obtained through such out-of-band means of communication. For example, an Iridum phone call can be used as an out-of-band means of communication. Iridium service can be obtained, for example, from Infosat Communications, Houston, Tex., USA.

FIG. 16 is a schematic view of a low side-lobe phased array 1600 of a thirteenth embodiment of this invention. The low side-lobe phased array 1600 comprises the following elements: an array of antenna elements 1650, a beam forming network 1630 with input beamports 1625 and output antenna ports 1640 connected to the array of antenna elements 1650, an N*P by Q RF switch 1620 connected to the input beamports 1625, a plurality of 1 by P RF splitters 1614 connected by lines 1616 to the N*P by Q RF switch 1620, and an M by N RF switch 1610 connected to the plurality of 1 by P RF splitters 1614 by lines 1612. The nomenclature "N*P by Q RF switch" means a radio frequency switch with a quantity of inputs equal to the product of an integer N times another integer P and the switch also has a quantity of outputs equal an integer Q. Similar definitions apply to the phrases "1 by P RF splitters" and "M by N RF switch." An example of an M by N (sometimes denotes as M×N) RF switch can be obtained in a Model S41/RF10×10 18 GHz, 10×10, Non-Blocking Matrix available from Keithley Instruments, Inc., Cleveland, Ohio, USA. In this example M=N=10.

The purpose of the M by N RF switch 1610 is to enable the low side-lobe phased array 1600 to be used with multiple (i.e. M) transceivers. The purpose of the 1 by P RF splitters 1614 is to spread a transmitted signal so that it can be applied to multiple beam ports in the beam forming network. In doing so, a narrow angle beam is formed within the beam forming network which results in a tapered amplitude distribution of RF power to the antenna elements in the array. It is well known in the art that to achieve low side lobes with antennas, it is necessary to provide an amplitude taper to the aperture. Normally in beam forming network-based antenna systems, a substantially uniform aperture illumination is created which results in larger side lobes in the corresponding antenna pattern. The purpose of the N*P by Q RF switch 1620 is to apply the split signal to the input beamports 1625 of the beam forming network 1630. Note that the N*P by Q RF switch 1620 can be comprised of a plurality of switches or groupings of switches. The purpose of having M, which can be greater than 1, inputs to the M by N RF switch 1610 is to enable simultaneous use of multiple transceivers with the low side-lobe phased array 1600.

FIG. 17 is a schematic view of a portion of an example of a low side-lobe phased array 1700. In this case, M is equal to 1. In other words, the number of transceivers is set to just one. This is shown in FIG. 17 by the labeling of "1×N" in a switch 1710. Furthermore, in this case P is set to 2. This means that the RF signal is sent to two beam ports in the beam former. This can be seen in FIG. 17 where one of connections of 1712 is split by a switch blade 1721 and a second switch blade 1723 which feed two input ports of a beam forming network 1730. The switch blade 1721 and the second switch blade 1723 are examples amongst a plurality of switch blades 1720. The switch blades 1720 are connected to the beam forming network 1730 via input lines 1725. Note that another feature is taught by FIG. 17 and is shown as matched resistive loads 1719 which are used to terminate other ports of beam forming network 1730 when they are not driven by an RF signal. The reason for terminating these ports is to minimize any reflected power that might otherwise be generated had such termination not been done. By minimizing such reflected power, one can help to assure that the low side-lobe properties of the instant invention are preserved. Output lines 1740 are connected to antenna elements (not shown).

FIG. 18 is a schematic view of a MIMO (multiple inputs, multiple outputs) enhanced phased array 1800 of a fourteenth embodiment of this invention. The MIMO enhanced phased array 1800 comprises the following elements: an array of antenna elements 1850, a beam forming network 1830 with a plurality of beam ports 1829 and a plurality of antenna ports 1840. The antenna ports 1840 are connected to the array of antenna elements 1850. The MIMO enhanced phased array 1800 further comprises the following elements: an M by N RF switch 1810 with M-side ports 1806 and N-side ports 1825 connected through the N-side ports 1825 to the plurality of beam ports 1829, and a plurality, M, of MIMO transceivers 1804 connected to the M by N RF switch 1810 through the M ports 1806. Also included is a switch controller 1812 which transmits control signals through switch control line 1814 to the M by N RF switch 1810. Thus, the M by N RF switch 1810 connects the MIMO transceivers 1804 to the beam ports 1829 and thereby connects the MIMO transceivers 1804 to a range of high gain antenna beams in free space. MIMO transceivers can be obtained, for example, in Linksys model WRT54GX4/WRT54G4 available from Linksys Irvine, Calif. USA.

Optionally, MIMO enhanced phased array 1800 additionally comprises power detectors 1828 connected to the beam ports 1829. Power detectors can be obtained, for example, as Model AD8318 from Analog Devices, Norwood, Mass., USA. The addition of power detectors 1828 enables the system to determine which beam ports 1829 correspond to directions in space where RF transmitters are active. Thus a mode of operation where the MIMO receivers are switched onto beams corresponding to directions in free space where RF power is being emitted can accomplished without resorting to a slower sequential search by trial and error (i.e. by sequentially connecting transceivers to all possible beam ports).

FIG. 19 is a schematic view of a high gain MIMO array 1900 of a fifteenth embodiment of this invention. High gain MIMO array 1900 comprises the following: an array of antenna elements 1950, a beam forming network 1930 with a plurality of beam ports 1929 and a plurality of antenna ports 1940, the antenna ports 1940 being connected to the array of antenna elements 1950, and a plurality of MIMO transceivers 1904 connected to the beam ports 1929. High gain MIMO array 1900 introduces a new type of MIMO system. Whereas conventional MIMO does digital signal processing on the signals from omni-directional antennas, the approach of the instant invention performs digital signal processing on high gain signals obtained from the combination of the array of antenna elements 1950 and the beam forming network 1930. This combination will yield much higher performance for long range applications where there is at least one strong direct or reflected line of sight (LOS) signal due to the much higher gain of the array of antenna elements 1950 compared with omni-directional antennas.

FIG. 20 is a schematic view of a multi-beam high gain array 2000 of a sixteenth embodiment of this invention. The Multi-beam high gain array 2000 comprises the following: an array aperture 2070, an array of antenna feed elements 2050, a beam forming network 2030 with a plurality of beam ports 2010 and a plurality of antenna feed ports 2040. The antenna ports feed 2040 are connected to the array of antenna feed elements 2050, and the array of antenna feed elements 2050 supply RF power to the array aperture 2070 (in transmit mode). The transfer of RF energy is indicated by the large arrow (in transmit mode). The array aperture can assume many forms including a flat panel array, supplied via waveguides (or, when a reflecting flat panel array, supplied via free space). The array aperture can alternatively be a parabolic trough shaped reflector (i.e. a reflector based on the shape of a parabolic line which is extruded in the direction orthogonal to the plane of the parabolic line) either fed directly or via a secondary reflector. The parabolic trough shape is different from the conventional RF parabolic reflector which has cylindrical symmetry (i.e. a parabolic line which is spun about an axis rather than extruded). The parabolic trough shape should be understood to include similar extruded shapes, such as cylindrical, even though they are not precisely described by a parabolic equation.

FIG. 21 is a schematic side-view of a multi-beam high gain aperture 2170 which is directly fed by array of antenna feed elements 2150.

FIG. 22 is a schematic side-view of a multi-beam high gain aperture 2270 which is fed via a secondary reflector 2260 by array of antenna feed elements 2250.

FIG. 23 is a schematic view of a 2D scanner 2300 in the Prior Art. Prior Art 2D scanners contain two stacks of beam forming lenses (see for example Archer in U.S. Pat. No. 3,979,754) shown as first stack of beam forming lenses 2330 and second stack of beam forming lenses 2350. In transmit mode, a signal is switched in 2D switch 2310 to one of lines 2320 (for clarity not all lines are shown) and sent to one selected beam forming lens amongst the first stack of beam forming lenses 2330. The one selected beam forming lens performs its power splitting and path delay operations on the signal and then sends its outputs to one input port each lens of the second stack of beam forming lenses 2350. Then each of the lenses of the second stack of beam forming lenses 2350 performs its operations on its signal and in turn sends signal via second stack of beam forming lenses outputs 2360 to antenna elements (not shown).

FIG. 24 is a schematic view of a 2D scanner 2400 which is another embodiment of the instant invention. By contrast, the novel approach illustrated here eliminates the need for a 2D switch and eliminates all but one of the first stacks of beam forming lenses. Thus, the present invention starts with a 1D means for selectively connecting 2405 which sends a signal to at least one input of a first-dimension beam directing network 2422 via one of lines 2415. The term beam directing network is used here to stand for a means of generating a multitude of copies of an input signal with controlled phase shifts (or preferably true time delay) and optionally amplitude alterations. The preferred methods of performing such an operation is to use a beam forming network as known generally in the art or as specifically indicated in this writing. Alternative methods of performing such an operation include phase shifting methods. While typical phase shifting methods are typically narrow-band in nature and hence generally not preferred, in some applications they may provide important advantages and therefore may become preferred in such applications.

Upon exiting first-dimension beam directing network 2422 via lines 2425 the RF signals are sent to a plurality of second-dimension means for selectively connecting 2435 to a plurality of second-dimension inputs 2445 to a plurality of second-dimension beam forming networks 2450. After the RF signals have been processed in this second dimension, they are sent via second-dimension outputs 2460 to antenna elements (not shown) for radiating into free space.

The schematic of FIG. 24 shows the first-dimension beam directing network as a planar object oriented perpendicular to the stack of second-dimension beam forming networks, but this method of illustration was chosen only to better teach the relationship to prior art. In practice, it will normally be preferred to orient the first-dimension beam directing network in the same plane as the stack of second-dimension beam forming networks thereby achieving a more compact and convenient system package. Thus, a 2D scanned system can be achieved with only a single stack of beam forming networks plus a layer of a single beam directing network.

The above-described and illustrated elements of the various embodiments of this invention are manufactured and connected to one another by conventional methods commonly used throughout the art unless otherwise specified.

It is generally appreciated that prior art (or classical) phased-arrays are very expensive (see for example, *Frontiers of Engineering: Reports on Leading Edge Engineering from the* 1996 *NAE Symposium on Frontiers of Engineering* (1997) National Academy of Engineering (NAE) Novel Ceramic Ferroelectric Composites, Louise C. Sengupta, U.S. Army Research Laboratory and see *Technology for the United States Navy and Marine Corps,* 2000-2035*: Becoming a* 21*st Century Force; Volume* 2*: Technology*, Sensors, Module Costs). Classical phased arrays typical cost $100 to $1,000 per element or more. Since arrays typically contain hundreds to thousands of elements system, system cost are usually in the range of $10,000 to $1,000,000. Furthermore, since classical phased arrays are so expensive they are typically only affordable in high-end applications such as satellites and some specialized radar systems. The instant invention provides a much more affordable electronically steerable antenna. As described above, the instant invention consists of inexpensive components, essentially circuit boards and a reduced number of RF switches. Thus while prior art is generally suitable in the $10,000 plus range, the instant invention enables steerable antenna technology below $1,000 (in direct manufacturing costs and exclusive of non-recurring engineering costs) and in some embodiments well below $1,000 (U.S. dollars in 2006).

It is also generally appreciated that classical phased arrays are also very heavy. Due to their large numbers of switching elements and amplifiers to overcome inefficiencies and thermal management systems to deal with excess heat generated, classical phased arrays can typically weigh in at several hundred pounds. Regarding system weight, as described above, the instant invention consists primarily of circuit boards that can be made with foam dielectric. Such foams can have extremely low density, e.g. 30 kg/m$^3$ or just $30\times10^{-6}$ kg/cm$^3$. Thus, a 30 cm by 30 cm (approximately 1 square foot) area that is 0.3 cm (~⅛") thick can have a mass of just 0.008 kg or 8 gm (i.e. weigh approximately 0.3 ounce). Since copper conductor sheeting is readily and economically available in gauges down to ½ ounce (which means ½ ounce per square foot) a two-conductor layered monolithic unit can have a mass of as little as 3.5 gm per 30 cm by 30 cm area (1.3 ounces/ft$^2$). Since a useful steerable array can be produced in an area approximately 30 cm by 30 cm or less, it is clear than the instant invention represents a dramatic reduction in weight over the prior art by being producible with a sub-kilogram mass and sub-pound weight. Thus, the instant invention can provide steerable antenna technology suitable for weight sensitive applications (specifically airborne and space) which can have broad applicability for antenna systems with masses below 14 kg (weights below about 30 pounds).

Similarly, the instant invention is suitable for small footprint applications (those with projected areas below 30 cm by 30 cm (approximately 1 square foot) area, and small volume applications (i.e. those below 60 cm×60 cm×6 cm), due to the compaction technology herein introduced.

The instant invention also operates in stark contrast to classical phased arrays with their multitudes of thermal problems. The instant invention, being dominated throughout most of its volume by passive lens and waveguide structures is inherently well suited for applications requiring tight isothermal tolerances (say 10 degrees Kelvin or better). These tight isothermal tolerances are often required to minimize mechanical movements to keep phase errors within limits. In addition, due to the passive nature of the steering mechanism, the power consumption of the steerable antenna can easily be less than 30 Watts (exclusive of any transceiver power considerations). Indeed the power consumption of the steerable antenna can even be less than 3 Watts since it is essentially just the power needed to drive an RF switch. Similarly, since the power consumption of the steerable antenna is so low, the steerable antenna is capable of removing any heat generated within it without resorting to any active cooling mechanisms.

The instant invention is clearly suitable for planar antenna applications. Furthermore, this instant invention has been described in planar terms, but it should also be clear (by the above discussion on rolling methods of compaction) that other simply curved surfaces could be accommodated (i.e. the array can conform to such surfaces).

The instant invention is suitable for producing high gain (gain greater than 10 dBi) or for making directional beams that are confined in height (to less than 50 degrees vertically) or that are confined in width (to less than 35 degrees). Since the instant invention is capable of wide angle scanning it can accommodate scanning over 40 degrees in azimuth, or even over 100 degrees in azimuth (when using, for example, a Rotman lens as its beamformer).

Since the instant invention can use true time delay as a mechanism for beam steering it can easily handle fractional bandwidths of five (5) percent or better. In fact, octave-bandwidth designs (or even better) are practical with Rotman lens-based designs. Clearly, 50 MHz or wider bandwidths can be used.

Once given the above disclosure, therefore, various other modifications, features or improvements will become apparent to the skilled artisan. Such other features, modifications, and improvements are thus considered a part of this invention, the scope of which is to be determined by the following claims.

What is claimed is:

1. An array comprising, a beam forming network for processing one or more signals with a plurality of inputs and a plurality of outputs;

a means for selectively connecting to at least one of said plurality of inputs; and an array of antenna elements connected to said plurality of outputs; wherein said means for selectively connecting comprises an N times P by Q RF (radio frequency) switch connected to said beam forming network inputs;

a plurality of 1 by P RF (radio frequency) splitters; and an M by N RF (radio frequency) switch connected to said plurality of 1 by P RF (radio frequency) splitters; where N, P, Q and M are understood to be integer numbers and P is equal to or greater than 2; whereby said 1 by P RF (radio frequency) splitters spread at least one of said signals so that it can be applied to more than one of said beam forming network inputs, thereby creating a low side-lobe beam in a radiation pattern of said array of antenna elements.

2. The array of claim 1 further comprising M radios connected to said M by N RF (radio frequency) switch.

3. An integrated phased array comprising, a lens beam forming network with a plurality of inputs and a plurality of outputs;

a means for selectively connecting to at least one of said plurality of inputs;

an array of antenna elements connected to said plurality of outputs; and an integrated unit comprising a dielectric layer sandwiched between an upper conductive layer and a bottom conductive layer;

wherein all three of:

said array of antenna elements;

said lens beam forming network;

said means for selectively connecting said plurality of inputs;

are disposed on either an upper surface or on a lower surface of said integrated unit; and a plurality of amplifiers disposed on either an upper surface or on a lower surface of said integrated phased array;

wherein said plurality of amplifiers is located between said lens beam forming network and said array of antenna elements.

4. A multibeam phased array comprising the integrated phased array of claim 3 and additionally comprising, a data network switch or router with network ports;

a plurality of radios with radio inputs and radio outputs, said radio inputs being attached to said network ports;

said input ports being connected to said radio outputs.

5. An integrated phased array comprising, a lens beam forming network with a plurality of inputs and a plurality of outputs;

a means for selectively connecting to at least one of said plurality of inputs;

an array of antenna elements connected to said plurality of outputs; and an integrated unit comprising a dielectric layer sandwiched between an upper conductive layer and a bottom conductive layer;

wherein all three of:

said array of antenna elements;

said lens beam forming network;

said means for selectively connecting said plurality of inputs;

are disposed on either an upper surface or on a lower surface of said integrated unit; and a plurality of amplifiers disposed on either an upper surface or on a lower surface of said integrated phased array;

wherein said plurality of amplifiers is located between said lens beam forming network and said means for selectively connecting said plurality of inputs.

* * * * *